US008070617B2

(12) United States Patent
Barron et al.

(10) Patent No.: US 8,070,617 B2
(45) Date of Patent: Dec. 6, 2011

(54) CHILD SWING AND JUMPER APPARATUS AND METHODS OF OPERATING THE SAME

(75) Inventors: Traci Barron, St. John, IN (US); Ross Carl, River Forest, IL (US); Paul J. Corsi, Terryville, CT (US); Douglas Melville, Jr., Simsbury, CT (US)

(73) Assignee: Kolcraft Enterprises, Inc., Chicago, IL (US)

( * ) Notice: Subject to any disclaimer, the term of this patent is extended or adjusted under 35 U.S.C. 154(b) by 487 days.

(21) Appl. No.: 12/044,588

(22) Filed: Mar. 7, 2008

(65) Prior Publication Data

US 2009/0033133 A1 Feb. 5, 2009

Related U.S. Application Data

(60) Provisional application No. 60/894,530, filed on Mar. 13, 2007.

(51) Int. Cl.
*A63G 9/14* (2006.01)
*A63G 9/12* (2006.01)

(52) U.S. Cl. ..... 472/118; 472/135; 482/69

(58) Field of Classification Search ..... 472/118–125, 472/135; 297/273, 274; 482/69, 75, 77, 482/78, 143
See application file for complete search history.

(56) References Cited

U.S. PATENT DOCUMENTS 342,855 A 6/1886 Abbey et al.
1,406,650 A 2/1922 Jones
2,023,235 A 12/1934 Count
2,697,477 A 12/1954 Welsh
3,146,985 A 9/1964 Grudoski
3,186,711 A 6/1965 Morrow
3,271,029 A 9/1966 Grudoski
3,759,539 A 9/1973 Goldberg
3,765,674 A 10/1973 Siler
4,022,510 A 5/1977 Saint
4,057,235 A 11/1977 Halopoff
4,138,104 A 2/1979 D'Amicis
4,150,820 A 4/1979 Bochmann
4,165,872 A 8/1979 Saint
D254,409 S 3/1980 Borucki
4,211,401 A 7/1980 Cunard
4,323,233 A 4/1982 Gebhard
4,324,432 A 4/1982 Eldon, III et al.
4,325,578 A 4/1982 Borucki (Continued)

OTHER PUBLICATIONS

International Search Report corresponding to International Application No. PCT/US2006/008070, mailed Sep. 25, 2006, 4 pages.

(Continued)

*Primary Examiner* — Kien T Nguyen
(74) *Attorney, Agent, or Firm* — Hanley, Flight & Zimmerman, LLC

(57) ABSTRACT

Child entertainment apparatus and methods of operating the same are disclosed. An example child entertainment apparatus includes a frame and a support suspended for swinging movement relative to the frame. The support is elastically elongatable. A child seat is carried by the support and thus is able to swing and bounce relative to the frame. A drive arm extends between the frame and the seat and includes a first end journalled for rotation relative to one of the frame or the seat and a second end slidably coupled to the other of the frame or the seat.

31 Claims, 15 Drawing Sheets

U.S. PATENT DOCUMENTS 4,452,446 A 6/1984 Saint
4,491,317 A 1/1985 Bansal
4,616,824 A 10/1986 Quinlan, Jr. et al.
4,688,850 A 8/1987 Brownlie et al.
D293,046 S 12/1987 Riehm
4,722,521 A 2/1988 Hyde et al.
4,785,678 A 11/1988 McGugan et al.
4,805,902 A 2/1989 Casagrande
4,822,033 A 4/1989 Kohus et al.
5,083,773 A 1/1992 Saint
5,342,245 A 8/1994 Webb, Jr.
5,378,196 A 1/1995 Pinch et al.
D368,816 S 4/1996 Mitchell et al.
5,525,113 A 6/1996 Mitchell et al.
5,533,936 A 7/1996 Julien et al.
5,624,321 A 4/1997 Snyder
5,628,689 A 5/1997 Saint et al.
5,704,882 A 1/1998 Coates et al.
D392,126 S 3/1998 Sack
5,769,727 A 6/1998 Fair et al.
5,788,014 A 8/1998 Saint et al.
5,803,817 A 9/1998 Stern
5,816,983 A 10/1998 Dawes et al.
5,833,545 A 11/1998 Pinch et al.
5,846,136 A 12/1998 Wu
5,848,553 A 12/1998 Miyazaki
5,855,140 A 1/1999 Imamura
5,857,944 A 1/1999 Cone et al.
5,876,311 A 3/1999 Coates et al.
D412,067 S 7/1999 Wu
5,975,631 A 11/1999 Fair et al.
5,996,192 A 12/1999 Haines et al.
6,010,410 A 1/2000 Lauro et al.
6,022,277 A 2/2000 Jankowski
6,027,409 A 2/2000 Favorito et al.
6,059,667 A 5/2000 Pinch
D428,268 S 7/2000 Fair
6,098,970 A 8/2000 Lowe
6,120,418 A * 9/2000 Plough ..... 482/69
6,193,224 B1 2/2001 Dillner et al.
6,260,833 B1 7/2001 Drager
6,273,505 B1 8/2001 Carnahan
6,283,870 B1 9/2001 Saint et al.
6,319,138 B1 11/2001 Fair et al.
6,339,304 B1 1/2002 Allison et al.
6,361,446 B2 3/2002 Lawson et al.
D456,189 S 4/2002 Flannery et al.
6,386,901 B1 5/2002 Caldwell
6,386,986 B1 5/2002 Sonner et al.
6,421,901 B2 7/2002 Sitarski et al.
6,428,098 B1 8/2002 Allbaugh
6,464,594 B1 10/2002 Canna et al.
6,471,597 B1 10/2002 Flannery et al.
6,500,072 B1 12/2002 Myers et al.
6,511,123 B1 1/2003 Sitarski et al.
6,520,862 B1 2/2003 Armbruster et al.
6,544,128 B1 4/2003 Yang
6,561,915 B2 5/2003 Kelly et al.
6,626,766 B1 9/2003 Hsia
6,645,080 B1 11/2003 Greger et al.
6,648,411 B2 * 11/2003 Julien ..... 297/274
6,666,473 B2 12/2003 Hartenstine et al.
6,666,505 B2 12/2003 Greger et al.
6,669,225 B2 12/2003 Greger et al.
D485,690 S 1/2004 Hsia
D486,965 S 2/2004 Hsia
6,692,368 B1 2/2004 Hyun
6,702,685 B2 3/2004 Mahlstedt et al.
6,705,950 B2 3/2004 Wood et al.
D490,993 S 6/2004 Longenecker et al.
6,824,472 B2 11/2004 Armbruster et al.
6,824,473 B2 11/2004 Wu
6,830,517 B1 12/2004 Ciraolo
6,857,700 B2 2/2005 Eastman et al.
6,857,966 B2 2/2005 Armbruster et al.
D503,055 S 3/2005 Longenecker et al.
6,872,146 B1 3/2005 Paesang et al.
6,875,117 B2 4/2005 Ransil et al.
6,877,802 B2 4/2005 Christensen et al.
D504,791 S 5/2005 Longenecker et al.
6,887,161 B2 5/2005 Mahlstedt et al.
6,896,624 B2 5/2005 Longenecker et al.
6,902,489 B2 6/2005 Greger et al.
6,908,397 B2 6/2005 Armbruster et al.
6,916,249 B2 7/2005 Meade
6,926,359 B2 8/2005 Runk
6,932,426 B2 8/2005 Greger
6,932,709 B1 8/2005 Gubitosi et al.
6,994,630 B2 2/2006 Paesang
7,052,403 B2 5/2006 Ransil et al.
7,066,536 B2 6/2006 Williams et al.
7,081,052 B2 7/2006 Greger et al.
7,326,120 B2 2/2008 Bellows et al.
7,607,734 B2 10/2009 Clapper et al.
7,770,971 B2 8/2010 Bellows et al.
7,824,273 B2 11/2010 Clapper et al.
7,878,915 B2 2/2011 Myers et al.
7,883,426 B2 2/2011 Bellows et al.
2003/0067193 A1 4/2003 Asbach et al.
2003/0199329 A1 10/2003 Wood et al.
2004/0102252 A1 5/2004 Longenecker et al.
2004/0102253 A1 5/2004 Ransil et al.
2004/0198511 A1 10/2004 Greger et al.
2004/0198512 A1 10/2004 Ransil et al.
2004/0198513 A1 10/2004 Wood et al.
2004/0198515 A1 10/2004 Wood et al.
2004/0239163 A1 12/2004 Runk
2004/0259647 A1 12/2004 Wood et al.
2005/0014569 A1 1/2005 Greger et al.
2005/0059502 A1 3/2005 Greger et al.
2005/0125970 A1 6/2005 Nolan
2005/0127727 A1 6/2005 Gangadharan et al.
2005/0225157 A1 10/2005 Patrizi et al.
2005/0239565 A1 10/2005 Ransil et al.
2006/0096153 A1 5/2006 Jung
2006/0194639 A1 8/2006 Greger et al.
2006/0214486 A1 9/2006 Ransil et al.
2006/0252564 A1 11/2006 Bellows et al.
2007/0111809 A1 5/2007 Bellows et al.
2007/0267904 A1 11/2007 Clapper et al.
2008/0217974 A1 9/2008 Velderman et al.
2009/0170618 A1 7/2009 Bellows et al.
2010/0201171 A1 8/2010 Velderman et al.

OTHER PUBLICATIONS

International Preliminary Report on Patentability corresponding to International Application No. PCT/US2006/008070, mailed Jul. 2, 2007, 7 pages.

Written Opinion of the International Searching Authority corresponding to International Application No. PCT/US2006/008070, mailed Sep. 25, 2006, 5 pages.

United States Patent and Trademark Office, "Requirement for Restriction/Election," issued in connection with U.S. Appl. No. 11/885,733, Oct. 10, 2010, (6 pages).

United States Patent and Trademark Office, "Notice of Allowance," issued in connection with U.S. Appl. No. 11/885,733, Dec. 16, 2010, (30 pages).

State Intellectual Property Office of China, "First Notification of Office Action," issued in connection with Chinese Patent Application No. 200680007334.5, May 8, 2009, (6 pages).

State Intellectual Property Office of China, "Second Notification of Office Action," issued in connection with Chinese Patent Application No. 200680007334.5, Aug. 30, 2010, (7 pages).

* cited by examiner

CHILD SWING AND JUMPER APPARATUS AND METHODS OF OPERATING THE SAME

CROSS REFERENCE TO RELATED APPLICATION

This application is a non-provisional application claiming priority from U.S. Provisional Application Ser. No. 60/894,530 filed Mar. 13, 2007, entitled "Child Swing and Jumper Apparatus and Methods of Operating the Same" and incorporated herein by reference in its entirety.

FIELD OF THE DISCLOSURE

This disclosure relates generally to child care products, and, more particularly, to child swing and jumper apparatus and methods of operating the same.

BACKGROUND OF RELATED ART

Infant swings of various types are known. One type of infant swing is an open top swing which, as its name suggests, does not include a bar or housing member above and across the seat. This opening above the seat facilitates inserting/removing an infant to/from the swing. Open top swings generally include a base or frame member which is disposed on the ground surface. A swing assembly is connected to and depends from the frame. The swing assembly is adapted to pivot relative to the frame assembly. The desired swinging movement is generated either manually or by a drive motor.

Infant jumpers of various types are also known. Some jumpers include a seat and spring supports for suspending the seat from a door frame or the like. A small child located in the seat can obtain exercise and entertainment by moving to cause the jumper to bounce within the door frame.

Bouncers which are constructed as reclined seats or bassinets are also known. These bouncers include a frame that positions the seat in a reclined position. The frame, which may be constructed of wire, experiences damped oscillatory movements when the child moves or when a care provider intentionally bounces the frame. Sometimes a mechanical vibrator is coupled to the frame to provide vibrations that can soothe or entertain an infant located in the bouncer.

In recent years, walker alternatives have been developed. Walker alternatives (sometimes referred to as bouncers, activity centers or child entertaining apparatus) generally include a base and a seat/sling that is suspended from a tray above the base. The tray is typically spaced a sufficient distance above the base such that the feet of a child seated in the seat/sling can reach the base to simulate standing. In some known walker alternatives, the tray is suspended above the base using adjustable columns to permit adjustment of the distance between the tray and the base to fit the height of the child.

The seats/slings of the known walker alternatives are typically rotatably suspended in the center of their trays such that the seats/slings are surrounded on all sides by their corresponding trays. Toys can be placed at various positions on the tray to encourage a child suspended in the seat/sling to use his/her legs to rotate themselves to reach the toys of interest. The bases of some known walker alternatives are cupped or bowled (e.g., semi-spherical) to permit rocking of the walker alternative. Some walker alternatives also suspend their trays, and, thus, their seats, using springs to permit bouncing of the tray, seat and/or child.

DETAILED DESCRIPTION

Figure 1:
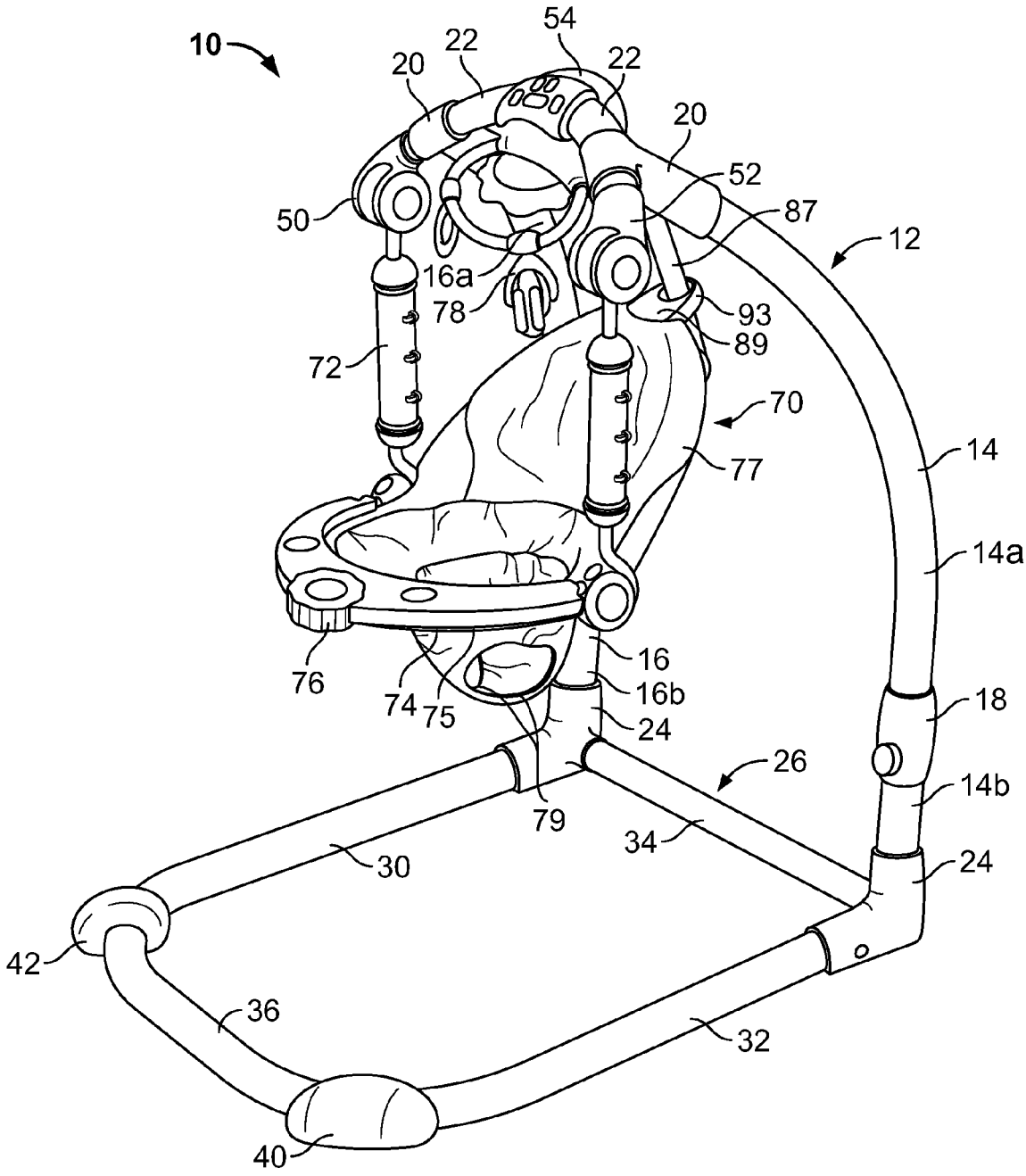
FIG. 1 is a perspective view of an example child swing and jumper apparatus constructed in accordance with the teachings of the present disclosure and showing the apparatus in a swing mode.
Figure 3:
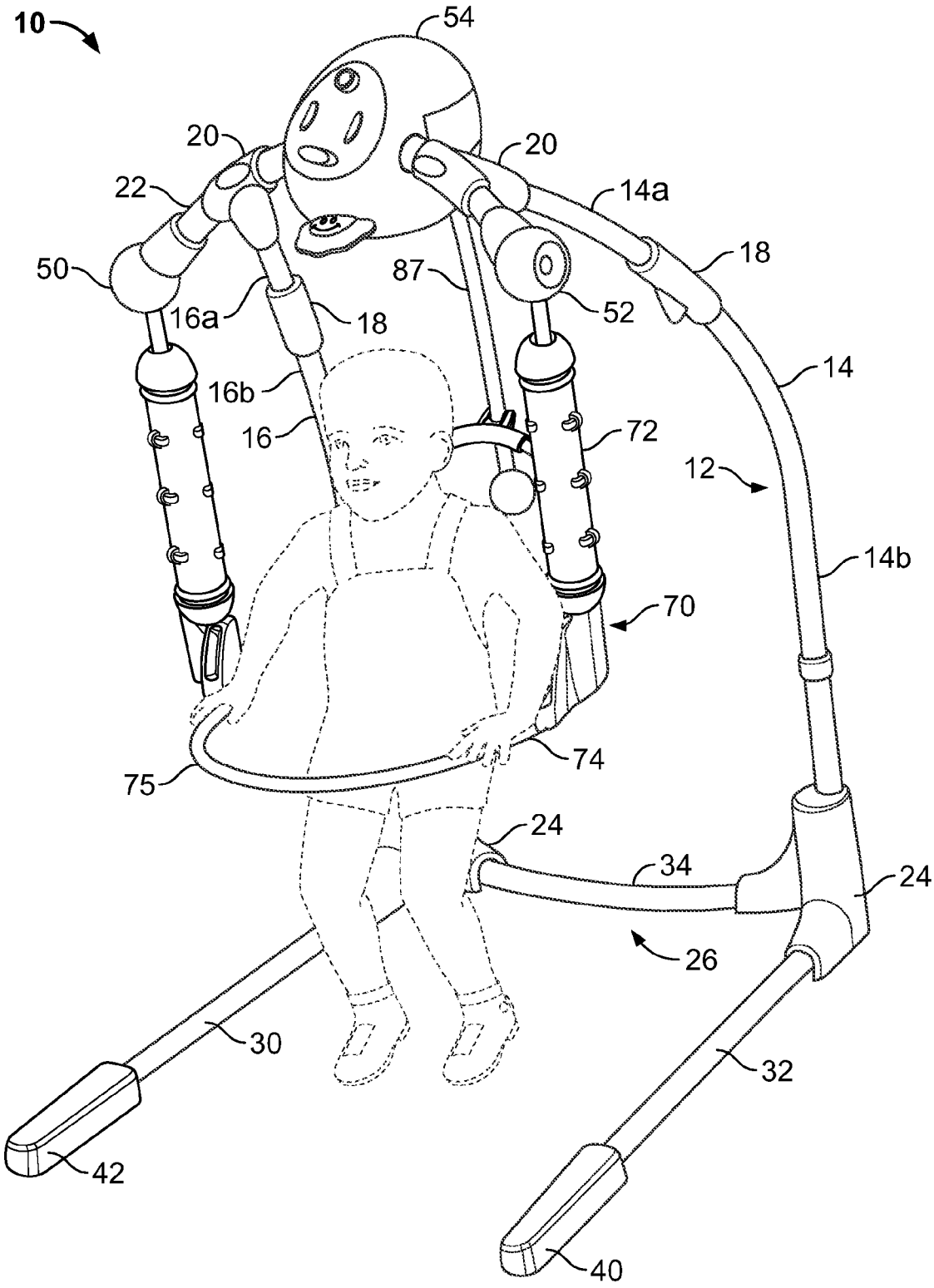
FIG. 3 is a perspective schematic view of another example child swing and jumper apparatus constructed in accordance with the teachings of the present disclosure and showing the apparatus in a jumper mode.

FIGS. 1 and 3 are perspective views of two alternative example child swing and jumper apparatus 10 constructed in accordance with the teachings of the present disclosure. The apparatus 10 of the illustrated examples have two modes of operation. In a first mode (FIG. 1), the apparatus 10 is operable as an infant swing. In a second mode (FIG. 3), the apparatus 10 is operable as a jumper. In some examples, the only difference between these modes is the power state of a drive motor as the child is permitted to swing and bounce in either the swing mode or the jumper mode.

Referring to FIGS. 1-6, in the illustrated examples, the apparatus 10 is provided with a free standing frame 12. The frame 12 of the illustrated example comprises plastic or metal tubular frame legs 14, 16. The tubular frame legs 14, 16, may be adjustable in length to change the overall height of the apparatus 10 by slidably and/or adjustably coupling an upper portion of the frame legs 14*a*, 16*a* to a respective lower portion of the frame legs 14*b*, 16*b*, through a height adjustment mechanism 18. Alternatively, the height of the apparatus 10 may be adjusted by changing the height and/or length of any other portion of the apparatus 10, including, for example, the swing arms, the seat, the frame, etc.

An upper end of each of the frame legs 14, 16 is fastened to one end of a respective connector 20. The connectors 20 support a cross bar 22. The bottom end of each leg 14, 16 is fastened to one end of a respective connector 24. Each connector 24 is fastened to a base support 26. In the illustrated examples, the base support 26 includes two side base support members 30, 32, and at least one base cross support member 34, 36. For instance, the example apparatus of FIGS. 1-2 includes a rear base cross support member 34 and a front base cross support member 36, while the example apparatus of FIG. 3-6 only includes the rear base cross support member 34. However, both examples include the side members 30, 32. In the illustrated examples, the rear base cross support member 34 is connected to and between the connectors 24, while the front base cross support member 36 (if present) is connected to and between the front ends of the side base support members 30, 32. In the illustrated examples, the side support members 30, 32 include base connectors 40, 42. Each of the connectors 24, 40, 42, and/or the base support members 30, 32, 34, 36 are adapted to seat on the ground surface to support and stabilize the apparatus 10.

Any or all of the legs 14, 16, the connectors 24, 40, 42, and/or the base support members 30, 32, 34, 36 may be manufactured in multiple connectable parts and/or of a single unitary structure. Moreover, the location, size, length, and/or configuration of any or all of the legs 14, 16, the connectors 24, 40, 42, and/or the base support members 30, 32, 34, 36 may be varied as desired, and may in some examples, be eliminated completely. Still further, each connector 24, 40, 42 may be joined to its respective leg 14, 16 and base support members 30, 32, 34, 36 in any desired manner (e.g., clipped, snapped to, riveted to, welded, glued, etc.).

As described above, the frame legs 14, 16 converge at their respective top leg ends and are mounted to and/or in the connectors 20. In the illustrated examples, the frame legs 14, 16 extend upward from each of the connectors 24 and are generally inclined toward the center of the base support 26 so that top ends of the frame legs 14, 16, when viewed from the top (FIG. 4), are located generally between the front and rear connectors 24, 40, 42, with the cross bar 22 extended between, and in these examples, beyond the connectors 20.

Each end portion of the cross bar 22 supports a respective pivot housing 50, 52. The cross bar 22 also supports a motor housing 54. The motor housing 54 is generally centrally located along the cross bar 22. The motor housing 54 serves to house a swing motor 90 (see FIG. 11) which, as described below, when actuated, drives a seat assembly through a swinging motion such as, for example, a generally arcuate motion, or a generally linear motion such as a generally horizontal plane. If desired, the swing motor 90 can be incorporated into or can be external of the housing 54. Further, the swing motor 90 can be powered by batteries or commercial alternating current (e.g., household AC). Alternatively, the motion can be applied by a wind-up spring mechanism (not shown). Still further, the apparatus 10 may not include any swing drive mechanism, but instead may be limited to manual swinging and/or bouncing.

In the illustrated example, a convertible swing and jumper assembly 70 is pivotably suspended from the housings 50, 52. The assembly 70 of the illustrated example includes two swing arms 72 and a seat 74. Each of the arms has a top pivotably mounted to a respective one of the housings 50, 52. Although the illustrated example includes two arms 72, other number or arms (e.g., 1, 3, 4, etc.) may alternatively be used.

The seat 74 is pivotably suspended between the arms 72. In this example, the seat 74 includes a frame such as, for example, at least one generally horizontally disposed peripheral tube 75 having soft fabric 77 suspended therefrom. The tube 75 may be a metal tube. The base of the seat 74 may be reclined by use of a fabric cinch and release system (not shown), such as a strap release to release a pivotal back frame tube 71 downwardly away from the substantially horizontal metal tube 75, thereby lowering the fabric 77 toward (and possibly below) the plane of the horizontal metal tube 75. In a swing operating mode (see FIGS. 1-2), a child may be placed in the seat 74 in a feet forward position. To configure the seat as a jumper (see FIGS. 3-6), the seat 74 and/or the soft fabric 77 defines leg openings 79 in its base to receive the legs of a child standing within the seat 74. In some examples, the leg openings 79 may be covered or substantially covered by, for example, a soft fabric layer (not shown) when the apparatus 10 is in the swing operating mode, and exposed when the apparatus 10 is in the jumper operating mode.

The structure of the seat may vary as desired. For example, the seat may include different fabric structures, different pivotal, adjustable, and/or rigid frame member(s), and/or different component parts, such as, for example, a molded plastic shell. Furthermore, the seat may include different panel(s), door(s), (moveable or fixed) and/or aperture(s) to allow differing positions of a child in the seat.

Figure 2:
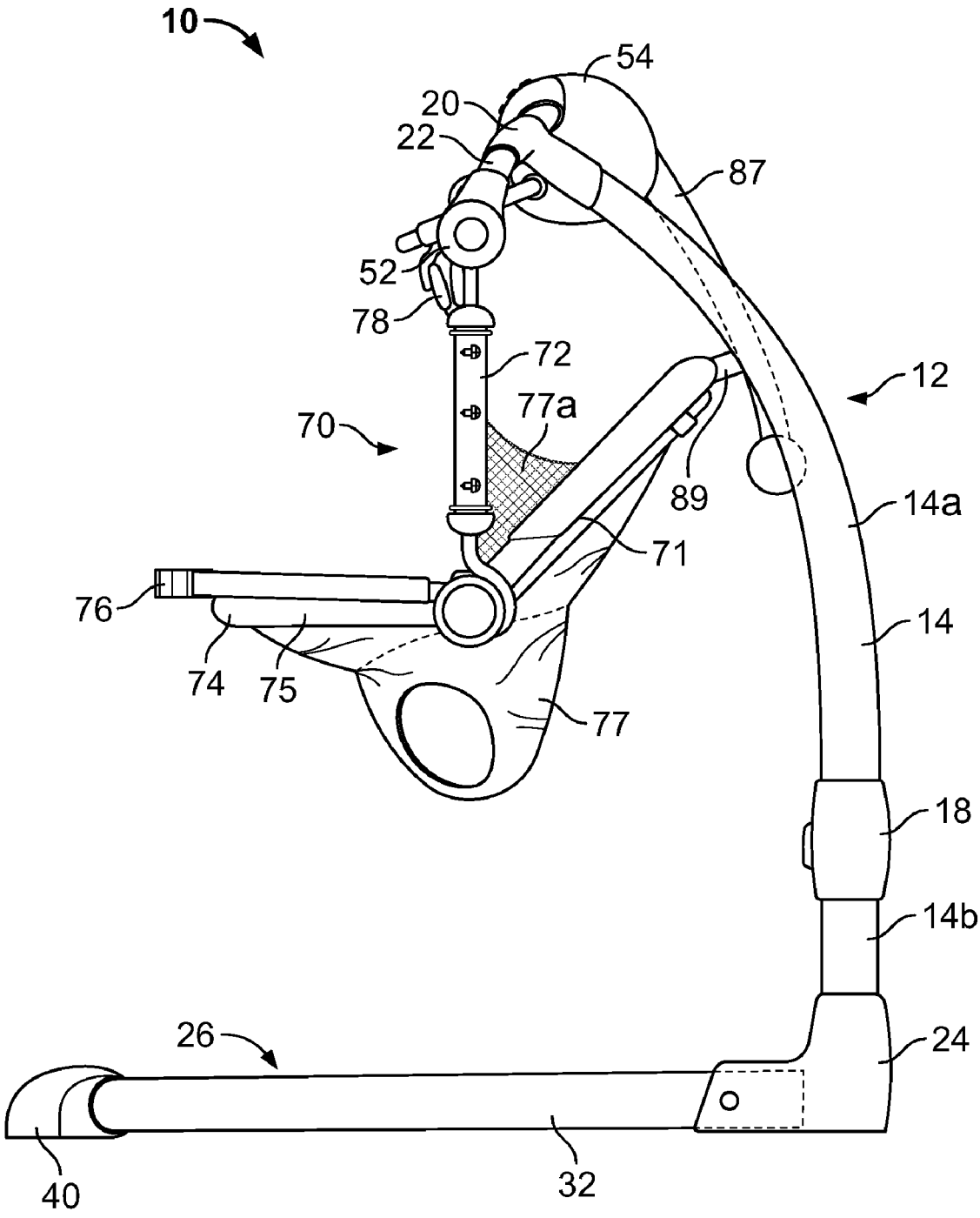
FIG. 2 is a right elevational view of the apparatus of FIG. 1.

In some examples, a fabric webbing 77*a* extends between the seat 74 and each of the swing arms 72 as illustrated in FIG. 2 to prevent a child from extending an appendage into the space between the seat 74 and the swing arm 72. Additionally, a mechanical vibrator (not shown) may be coupled to the frame, swing arms, and/or the seat to provide vibrations that can soothe or entertain a child located in the seat 74 in either the jumper or the swing mode.

Figure 4:
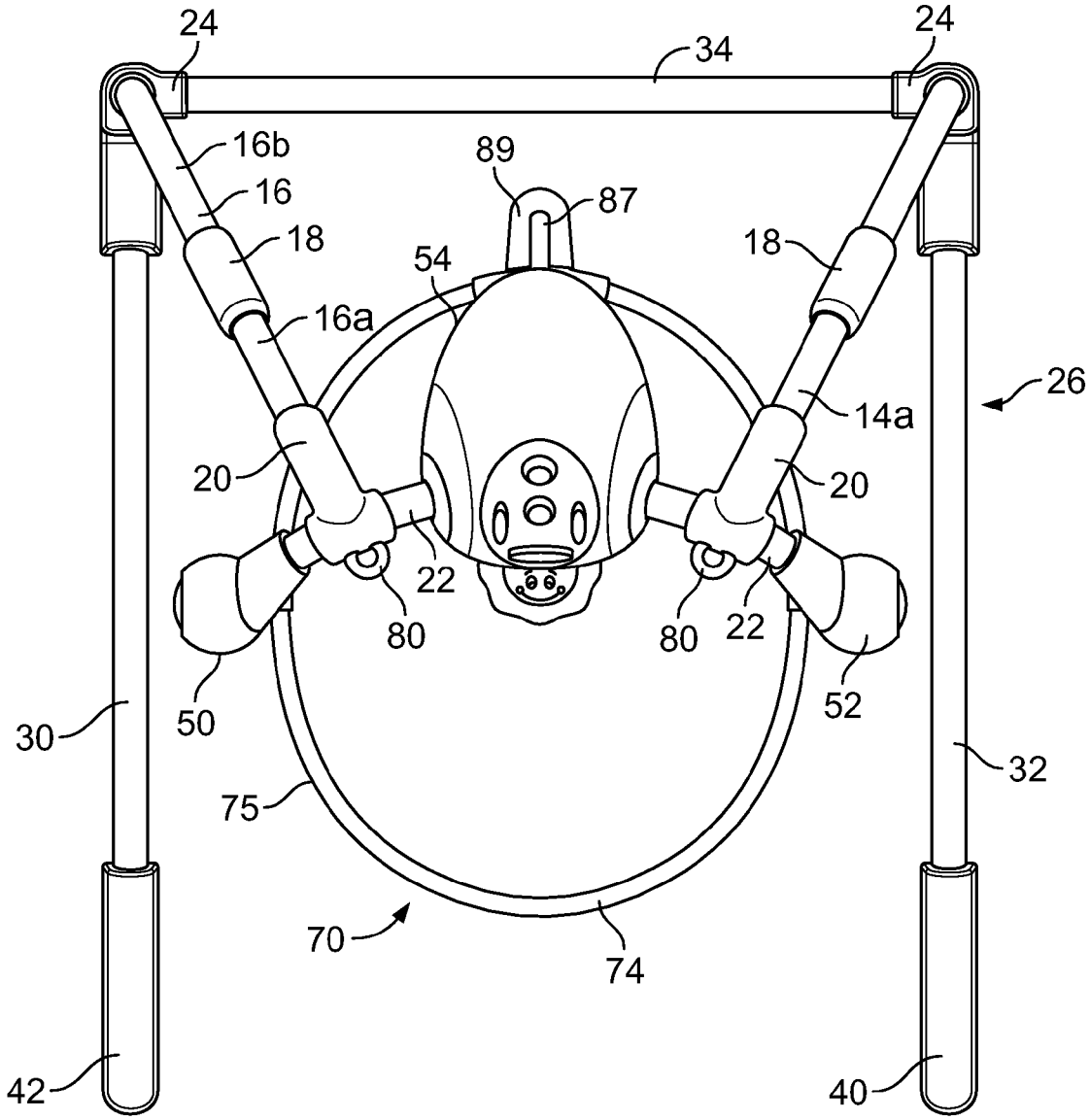
FIG. 4 is a top plan view of the apparatus of FIG. 3.

In order to support food, toys, and/or other items in front of and/or above a child seated in the seat 74, the apparatus 10 may be further provided with a tray 76, and/or a mobile 78, coupled to the cross bar 22. The mobile 78 of the illustrated example is coupled to the cross bar 22 (or other structure) via any suitable connection including, for instance, hook and loop connections, ties, and/or fasteners, which couple the mobile 78 to connection loops 80 mounted on the connector 20 (FIG. 4). In the example illustrated in FIGS. 1-2, the tray 76 may be used to support one or more toys. The tray 76 may further be removably and/or pivotally mounted to the seat 74. In the illustrated example of FIGS. 3-6, the tray 76 is removed from the seat 74 but may be reattached, removed, and/or pivoted as desired.

To facilitate conversion between the swing mode and the jumper mode, the swing arms 72 of the illustrated example are implemented by suspending means such as, for example, the illustrated convertible arms 72. As shown in FIGS. 7A-7E, each of the swing arms 72 includes two telescoping tubes. Each of the telescoping tubes includes a rigid inner tube 81 and a rigid outer tube 82. Each swing arm 72 also includes a flexible connector, such as a spring 84 coupling the inner tube 81 to the outer tube 82 so that the inner tube 81 resiliently slides and/or telescopes with respect to the outer tube 82.

Figure 7A:
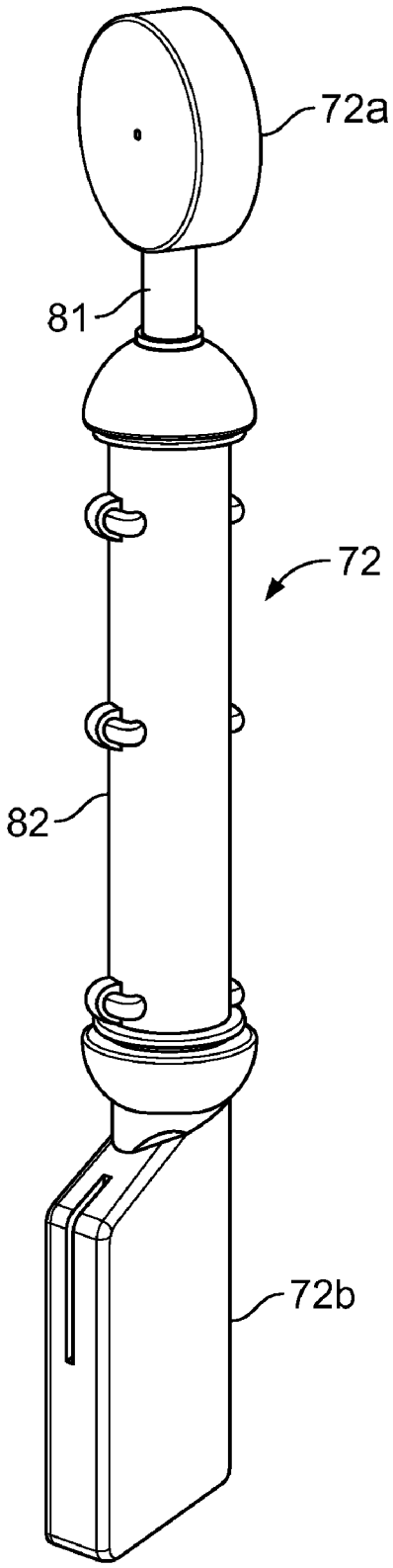
FIG. 7A is a perspective view of one of the two swing arms for use in conjunction with the apparatus of FIG. 1 or FIG. 3.
Figure 7B:
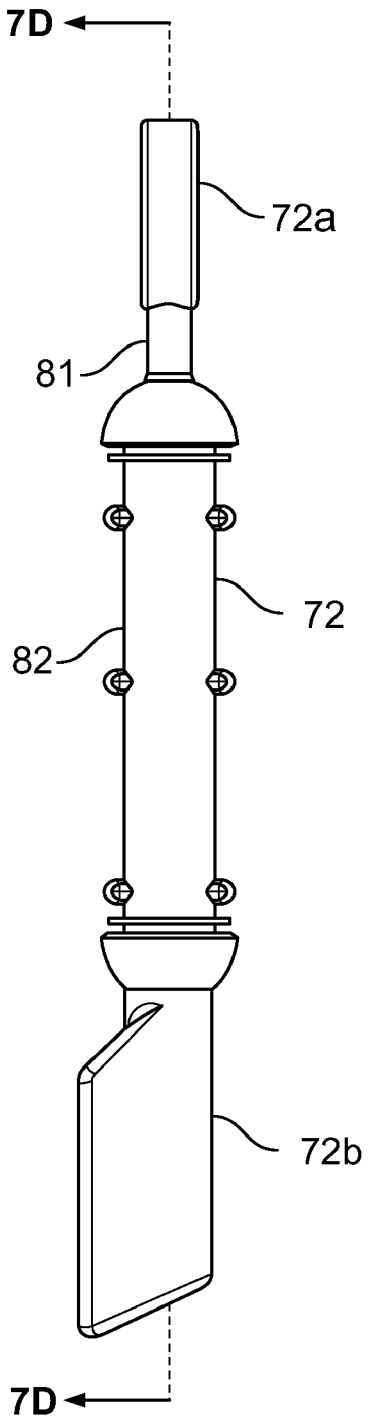
FIG. 7B is a right side view of the swing arm of FIG. 7A.
Figure 7C:
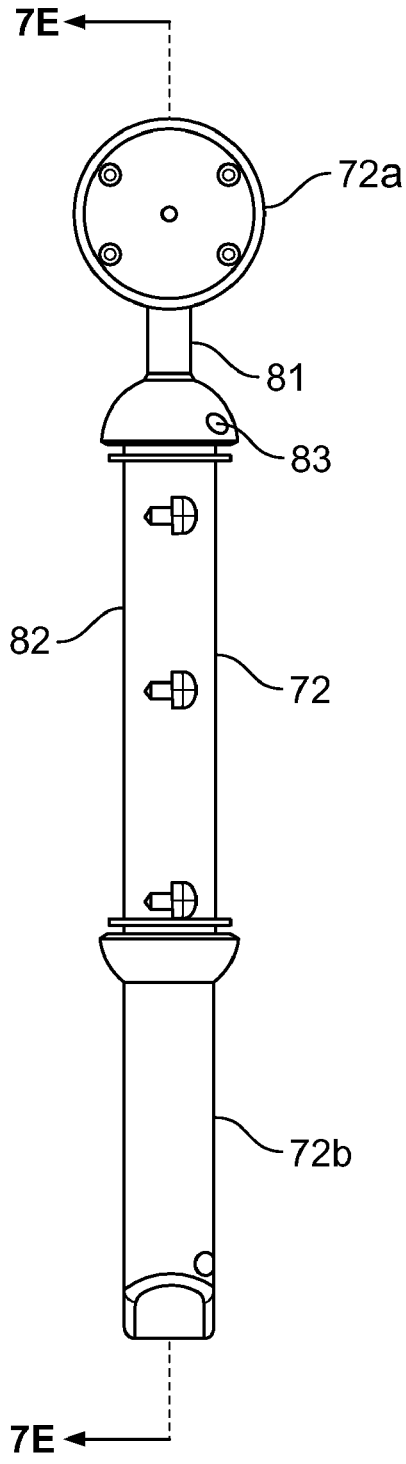
FIG. 7C is a front side view of the swing arm of FIG. 7A.
Figure 7D:
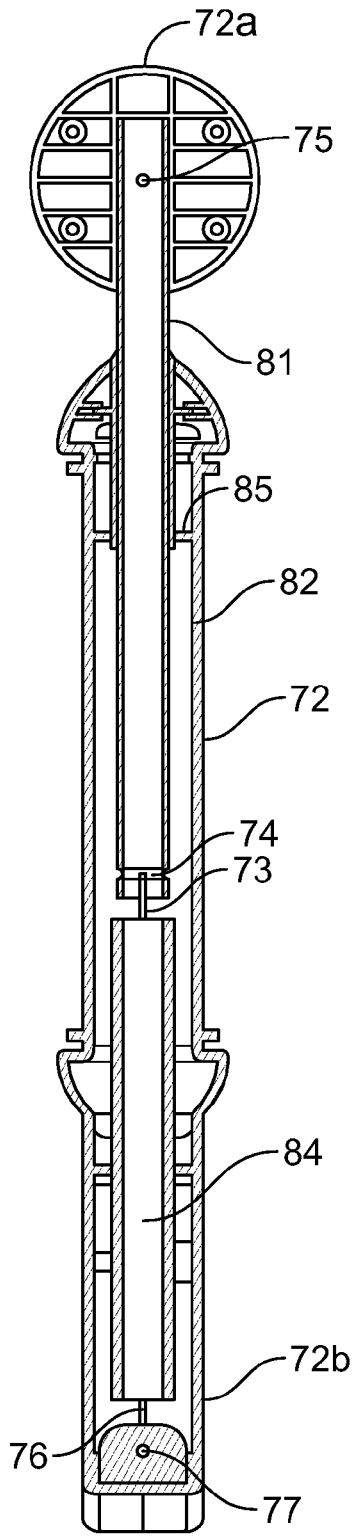
FIG. 7D is a cross sectional view taken along line 7D-7D of FIG. 7B.
Figure 7E:
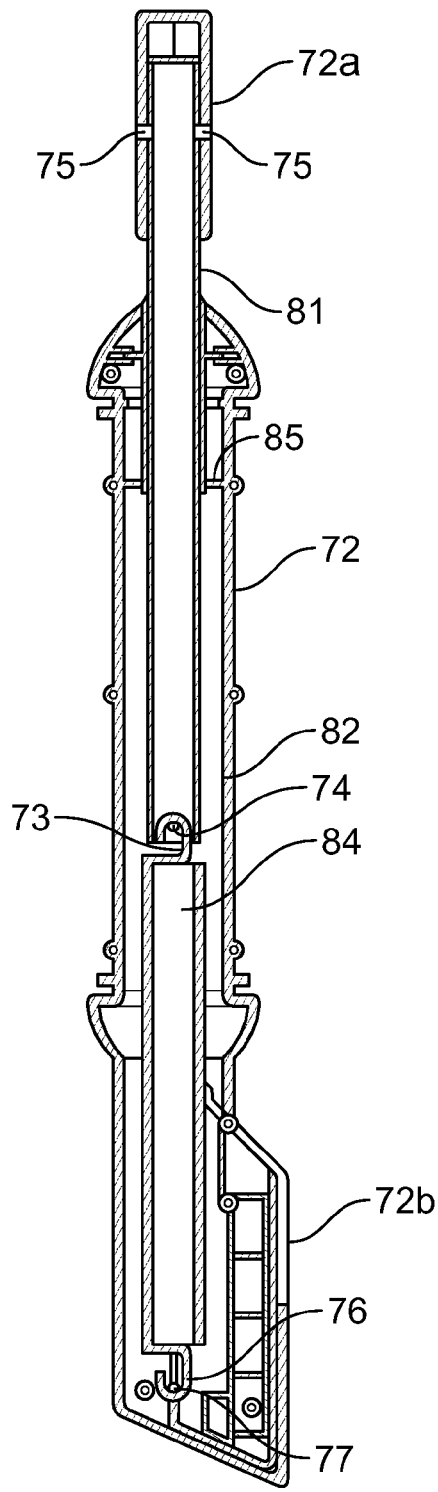
FIG. 7E is a cross sectional view taken along line 7E-7E of FIG. 7C.

In the illustrated example, the swing arm 72 includes at least one spring 84 operatively coupled at one end to the inner tube 81 by, for example, a hook 73 and pin 74 as shown in FIGS. 7D and 7E. The inner tube 81 is in turn pivotally mounted to a respective one of the housings 50, 52 at an upper end 72*a* of the arm 72. Specifically, the upper end 72*a* is journalled on a respective one of the housings 50, 52 for rotating/swinging motion by, for example, a pivot assembly (not shown) accepted by an aperture 75 formed in the upper end 72*a*. The other end of the spring 84 is operatively coupled to the end of the outer tube 82 by, for example, a hook 76 and pin 77 similar as shown. The outer tube 82 is mounted to a respective side of the seat 74 at a lower end 72*b* of the arm 72. The spring 84 of the illustrated example is at least partially covered by outer tube 82 to reduce pinch points sometimes associated with the use of a spring, and/or to enclose the spring in case of failure. Additionally, the spring 84 may be replaced and/or supplemented by any suitable flexible material and/or device, including for example, a bungee cord, elastic band, and/or other suitable material. The tubes 81, 82 are slidably coupled to telescope between an extended position and a retracted position. The rigidity of the tubes 81, 82 allows the apparatus to function as a swing, while the elasticity of the spring 84 allows an operator to impart vertical (i.e. bouncing) movement to the seat 74 of the apparatus 10. In the illustrated examples, the tubes 81, 82 of the swing arm 72 are allowed to move (i.e., telescope) relative to each other in both the swing and the jumper modes. In the illustrated example, the swing arm 72 includes position stops 85 to limit the extension of the tubes 81, 82, thereby allowing the spring 84 to extend fully under a load, yet prevent the spring 84 from over extending.

Figure 8A:
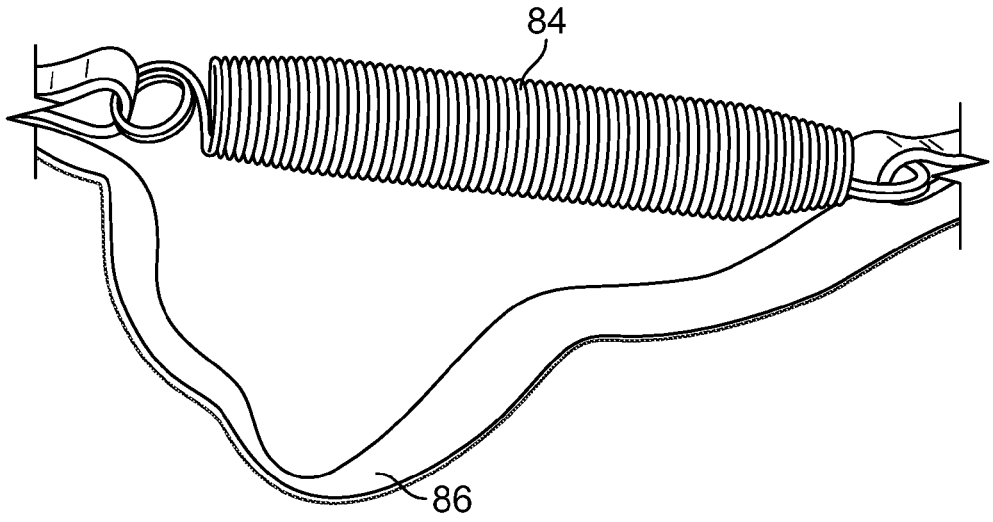
FIG. 8A is an enlarged view of the spring of FIG. 7A-7E.
Figure 8B:
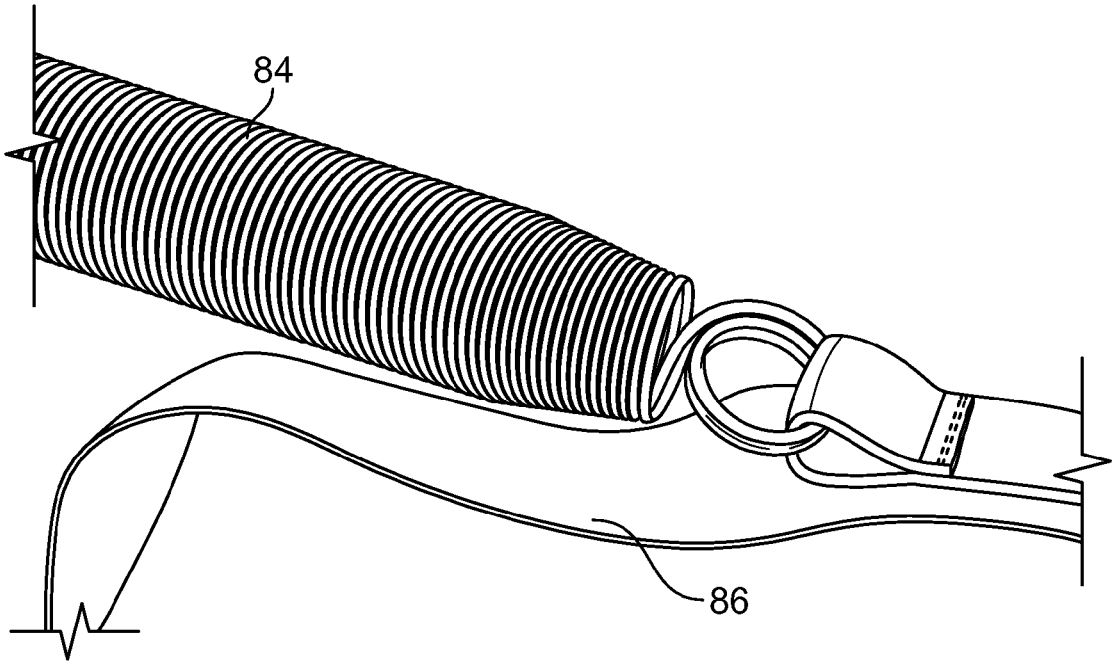
FIG. 8B is similar to FIG. 8A, but showing additional detail of the spring and tether.

Furthermore, as shown in FIG. 8, the spring 84 of the illustrated example is provided with a safety tether 86, such as webbing, to prevent the spring 84 from over extending and/or to provide a fail-safe connection between the tubes 81, 82 in the case of a spring failure.

The arm 72 may be provided with a lock (not shown) to selectively allow relative movement between the inner tube 81 and the outer tube 82. For example, the lock may include a pivotal bypass, such as a rigid arm, a friction connection, a threaded connection, and/or a pin and aperture lock arrangement, such that the lock may be shiftable between an engaged and disengaged position. When the lock is in the engaged position, it substantially prevents relative sliding movement (i.e., telescoping) between the inner tube 81 and the outer tube 82, thus providing a rigid connection between the tubes 81, 82. As a result, relative motion between the tubes 81, 82 is prevented, and the arm 72 becomes substantially rigid. In this way, telescoping movement between the tubes 80, 82 is effectively removed and, accordingly, the apparatus 10 is configured to function solely as a swing when motion is imparted to the seat 74. An apparatus with such a lockout mechanism is shown in U.S. application Ser. No. 11/885,733, entitled "Child Swing and Jumper Apparatus and Methods of Operating the Same" and hereby incorporated by reference in its entirety.

When, on the other hand, the lock is in the disengaged position, relative movement between the inner tube 81 and the outer tube 84 is permitted, and the seat 74 is, thus, suspended from the springs 84 of the arms 72. As a result, the effective length of each of the arms 72 is variable such that the seat 74 may be bounced relative to the housings 50, 52 during both swing and/or jumper modes (e.g., when the lock is disengaged) by an occupant of the seat 74.

Figure 5:
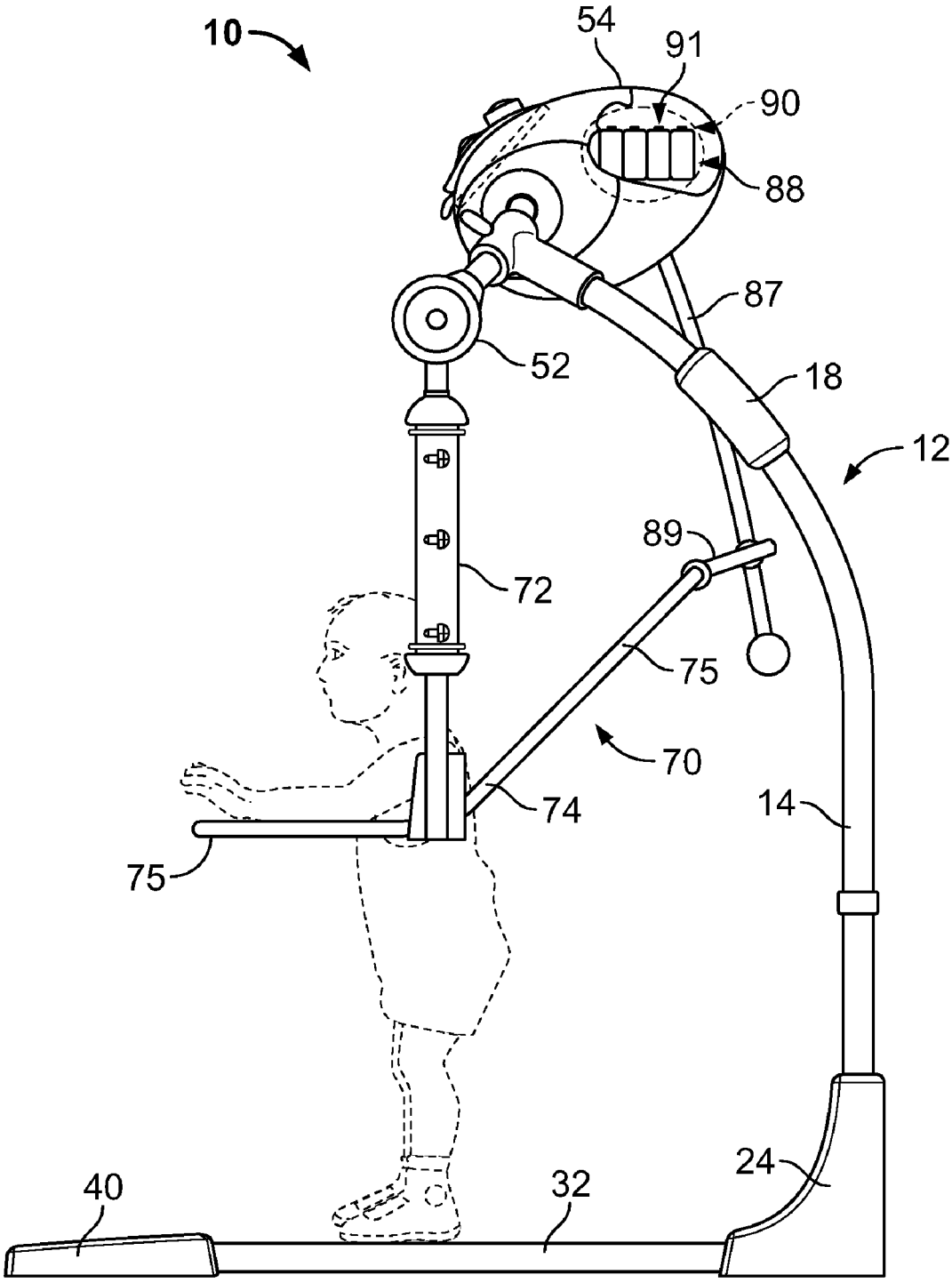
FIG. 5 is a right side view of the apparatus of FIG. 3.
Figure 6:
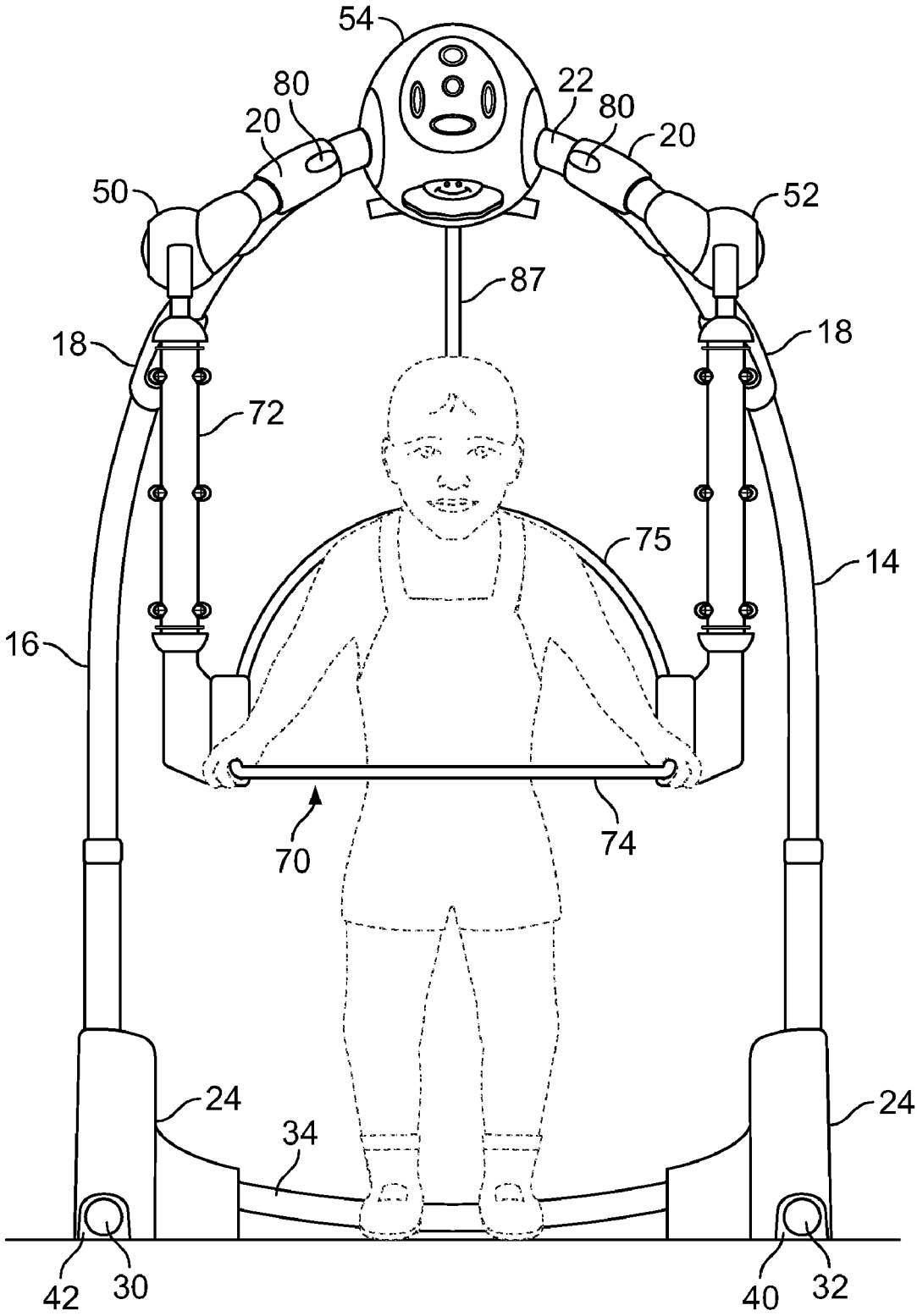
FIG. 6 is a front side view of the apparatus of FIG. 3.

In order to impart motion to the seat assembly 70, the seat 74 is coupled to the swing motor 90 through a drive arm 87. As illustrated in detail in FIGS. 9-10, in some examples, one end of the drive arm 87 is coupled to the drive motor 90, such as, for example, by extending through a channel 88 defined by the housing 54 (FIG. 5). The other end of the drive arm 87 is coupled to the seat 74. In this example, the drive arm 87 is slidably coupled to the seat 74 by a yoke or connector 89. The connector 89 is releasably attached through a friction clip 91 to the peripheral tube 75 of the seat 74 to couple the drive arm 87 to the connector 89. In the examples shown in FIG. 1 and FIG. 9, the connector 89 defines an aperture 93, which is sized to allow passage of the drive arm 87 therethrough. The drive arm 87 may therefore, slide relative to the connector 89 during operation. To assist in reducing friction between the drive arm 87 and the connector 89 while sliding relative to one another, one or more rollers 95 (see FIG. 10) or other suitable friction reducer(s) may line the aperture 93. Additionally, to prevent the end of the drive arm 87 from passing through the aperture 93 of the connector 89, the end of the example drive arm 87 includes an end cap 97 or other suitable device of a size too large to pass through the connector 89.

Figure 9:
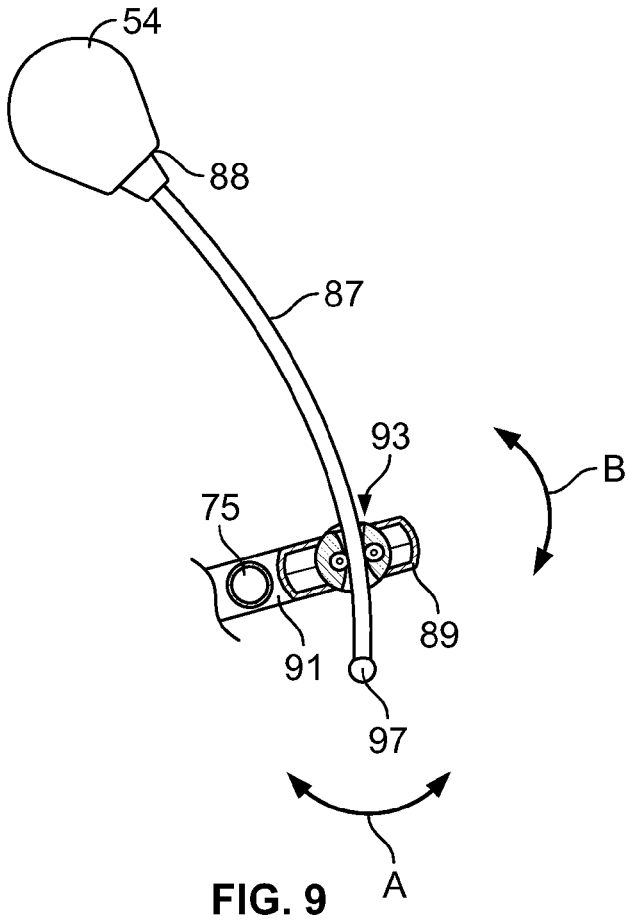
FIG. 9 is an enlarged sectional elevational view of the drive arm and seat connector for use in conjunction with the apparatus of FIG. 1 or FIG. 3.
Figure 10:
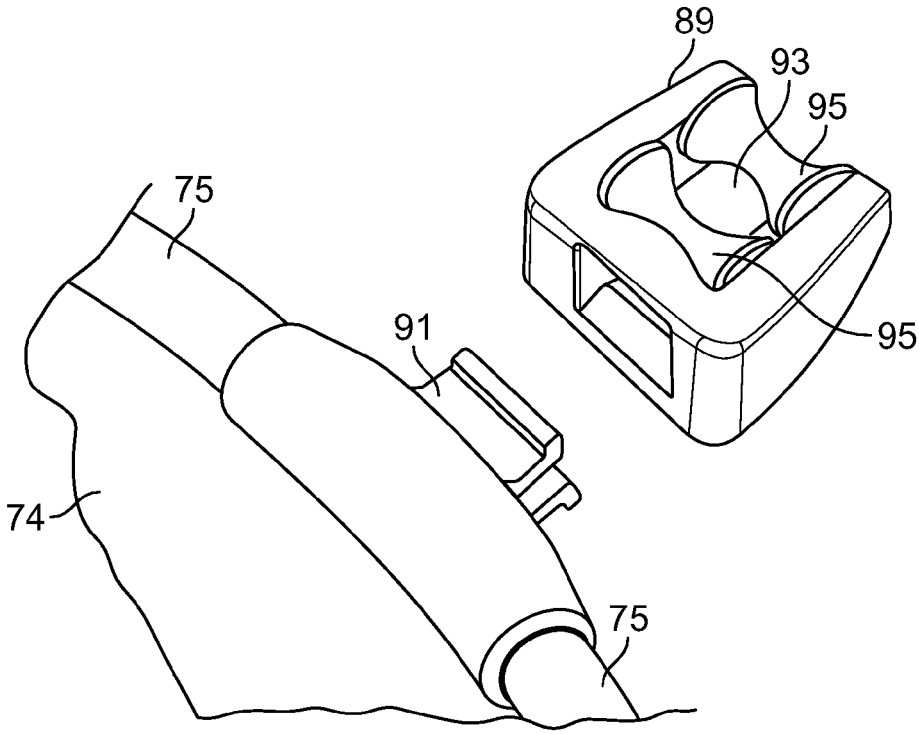
FIG. 10 is an enlarged perspective view of the connector of FIG. 9.

In operation, the drive arm 87 acts on the center of the seat 74, to impart swinging motion to the seat 74, but also allows for vertical motion of the seat 74 (i.e. bouncing) by slidably coupling the drive arm 87 to the seat 74 through the connector 89. In particular, during swing mode operation, the swing motor 90 imparts reciprocal motion to the drive arm 87 in the direction of the arrows A (FIG. 9). As a result, the drive arm 87 pulls and/or pushes the connector 89, and, thus, the seat 74, such that the seat 74 swings beneath the housings 50, 52. During operation, the connector 89 is free to slide along the length of the drive arm 87 in the direction of the arrow B (FIG. 9), thereby allowing vertical motion (i.e. bouncing) of the seat 74. By being slidably coupled to the drive arm 87 through the connector 89, vertical motion of the seat 74 will not be transferred into vertical motions of the drive arm 87 and/or the swing motor 90. As a result, the seat 74 is free to bounce in both the swing and jumper modes of the apparatus without causing damage to the drive mechanism of the apparatus.

The illustrated apparatus 10 includes a single drive arm. However, multiple drive arms, such as side mounted drive arms (e.g. swing arms), or bottom mounted arm may instead be employed. Additionally, the connector 89 may include any suitable connection for coupling the drive arm 87 to the seat 74, such as, for example, a friction fit, a four-bar-linkage, etc., and may alternatively be permanently or releasably connected to the seat 74 by clipping, snapping, or otherwise holding the connector 89 to the seat 74. Additionally, the connector 89 may be integrally or separately formed with the seat 74 and/or the drive arm 87. Still further, the drive arm 87 may be fixed in relation to the seat 74, while being slidably and/or pivotally coupled to the housing 54.

Figure 11:
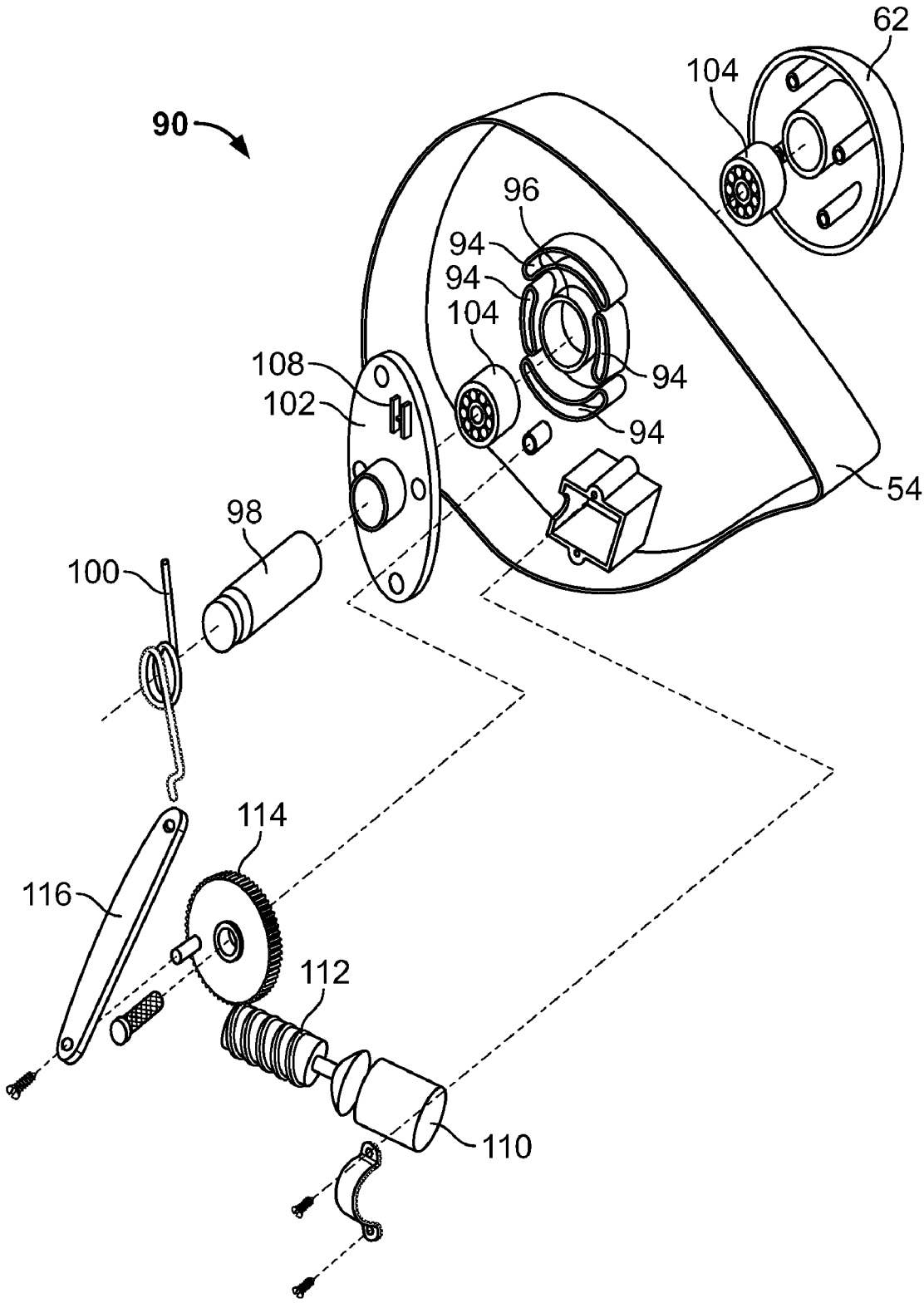
FIG. 11 is an exploded perspective view of an example swing motor for use in conjunction with the apparatus of FIG. 1 or FIG. 3.

FIG. 11 is an exploded perspective view of an example swing motor 90 that is configured to drive the seat 74 when the apparatus 10 is in the swing mode. In the illustrated example, the swing motor 90 is provided in the housing 54. The housing 54 defines a plurality of preformed channels 94 and an axle opening 96 holding a fixed (non-rotating) axle 98. Pivotally mounted to the axle 98 is a drive spring 100, a drive plate 102, a pair of pivot bearings 104, and a hub 62. The drive spring 100 may be coupled to the drive plate 102 via a channel 108, formed, in this example on the surface of the drive plate 102. There may be lost motion between the spring 100 and the channel 108. The drive plate 102 includes a plurality of projections (not shown) to extend at least partially into the channels 94, to limit and/or guide the motion of the drive plate 102 and mate with projections in the hub 62.

To move the drive spring 100, the drive plate 102, and the swing arm 106, the drive spring is coupled to a motor 110. In the illustrated example, the motor 110 is coupled to a worm gear 112 to rotatably drive the same. The worm gear 112, in turn, is operatively coupled to a planetary gear 114 rotatably mounted to the housing 54. A link arm 116 includes a first end pivotally mounted to a carrier on the periphery of the planetary gear 114 and a second end coupled to the drive spring 100 for pivoting the drive spring 100 about the axle 98. There may be lost motion between the link 116 and the spring 100. The rotation of the motor 110 translates into a generally arcuate swing motion of the hub 62. The hub 62 is coupled to the drive arm 87. As a result, the motor 110 drives the drive arm 87 into reciprocating motion via the drive chain explained above.

The swing motor 90 may include a plurality of user operable buttons 120 that may be used to set a different operating conditions such as, for example, the speed or period of the swinging motion, music and/or lighting associated with the apparatus 10, and/or any other operating parameter.

Figure 12:
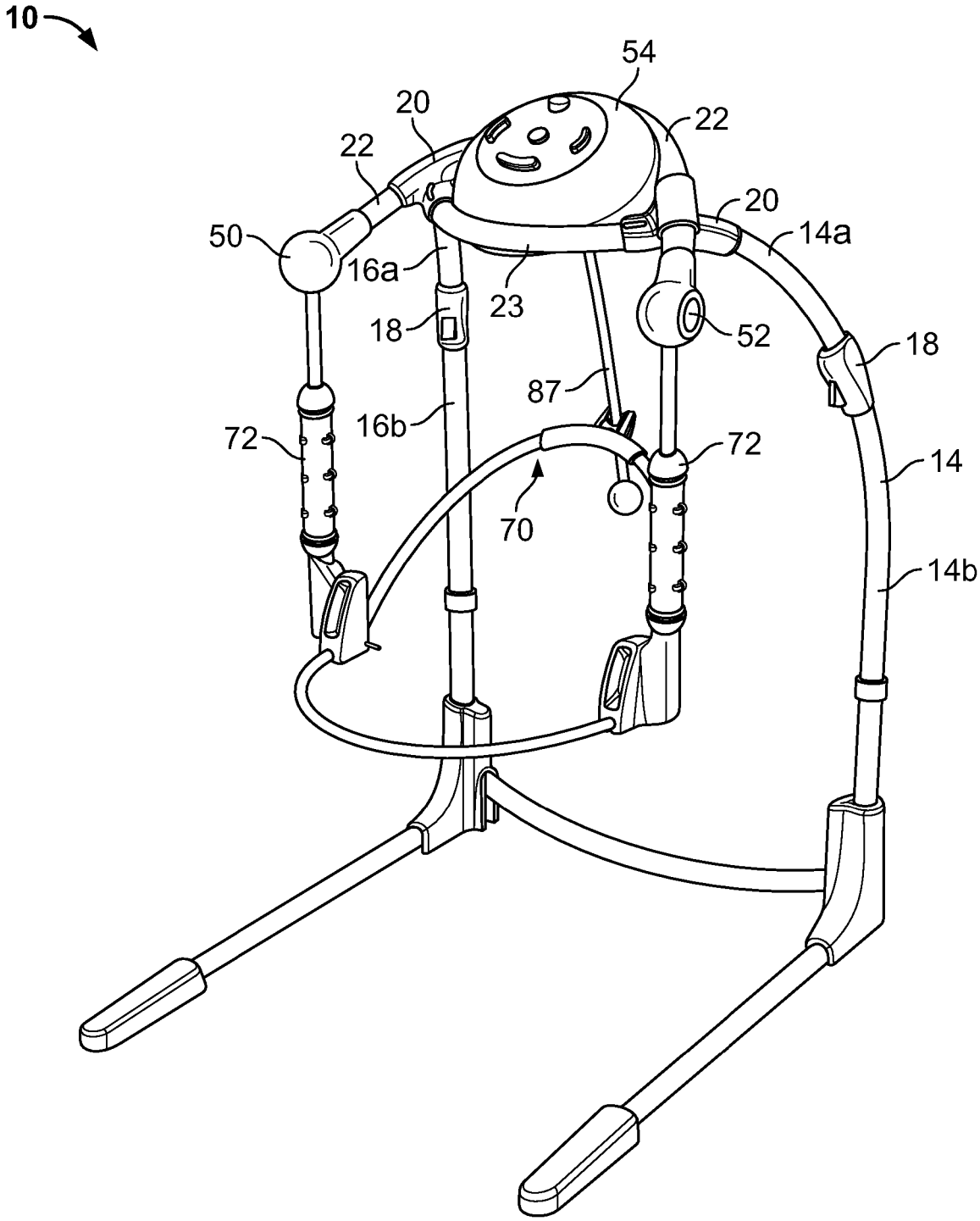
FIG. 12 is a perspective view of another example child swing and jumper apparatus constructed in accordance with the teachings of the present disclosure.

FIG. 12 is a perspective view of another alternative example child swing and jumper apparatus 10 similar to FIG. 3, but with a different frame 12 and housing 54 construction. In particular, in this example, the upper end of each of the frame legs 14, 16 is fastened to one end of a respective connector 20, while the connectors 20 support the first cross bar 22, as well as a second cross bar 23. The first cross bar 22 supports the pivot housings 50, 52 at each end of the first cross bar 22, while both the first cross bar 22 and the second cross bar 23 cooperate to support the motor housing 54 generally centrally located along the cross bars 22, 23.

Figure 13A:
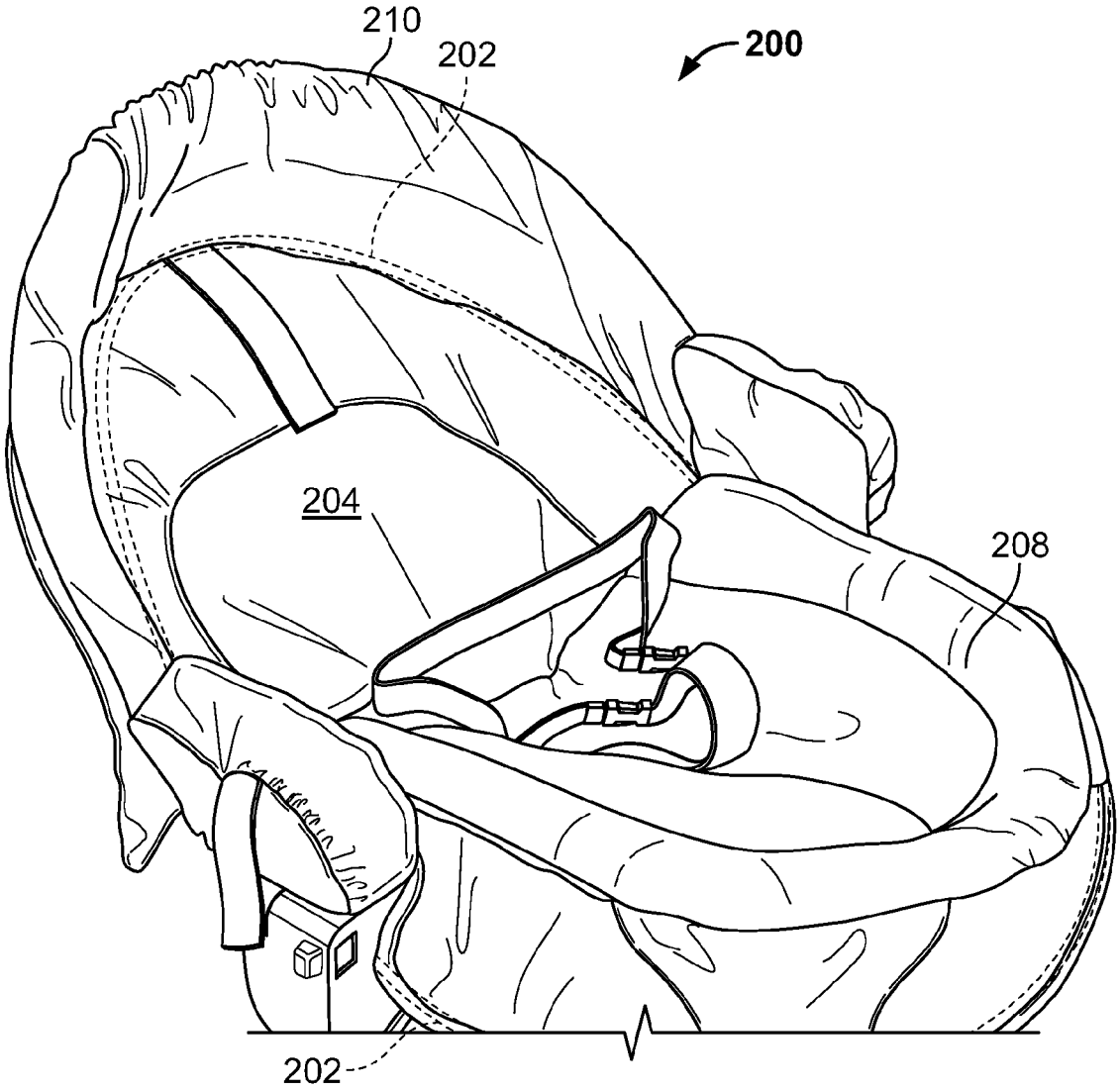
FIGS. 13A-13B are perspective views of an example seat that may be utilized in the example child swing and jumper apparatus.
Figure 13B:
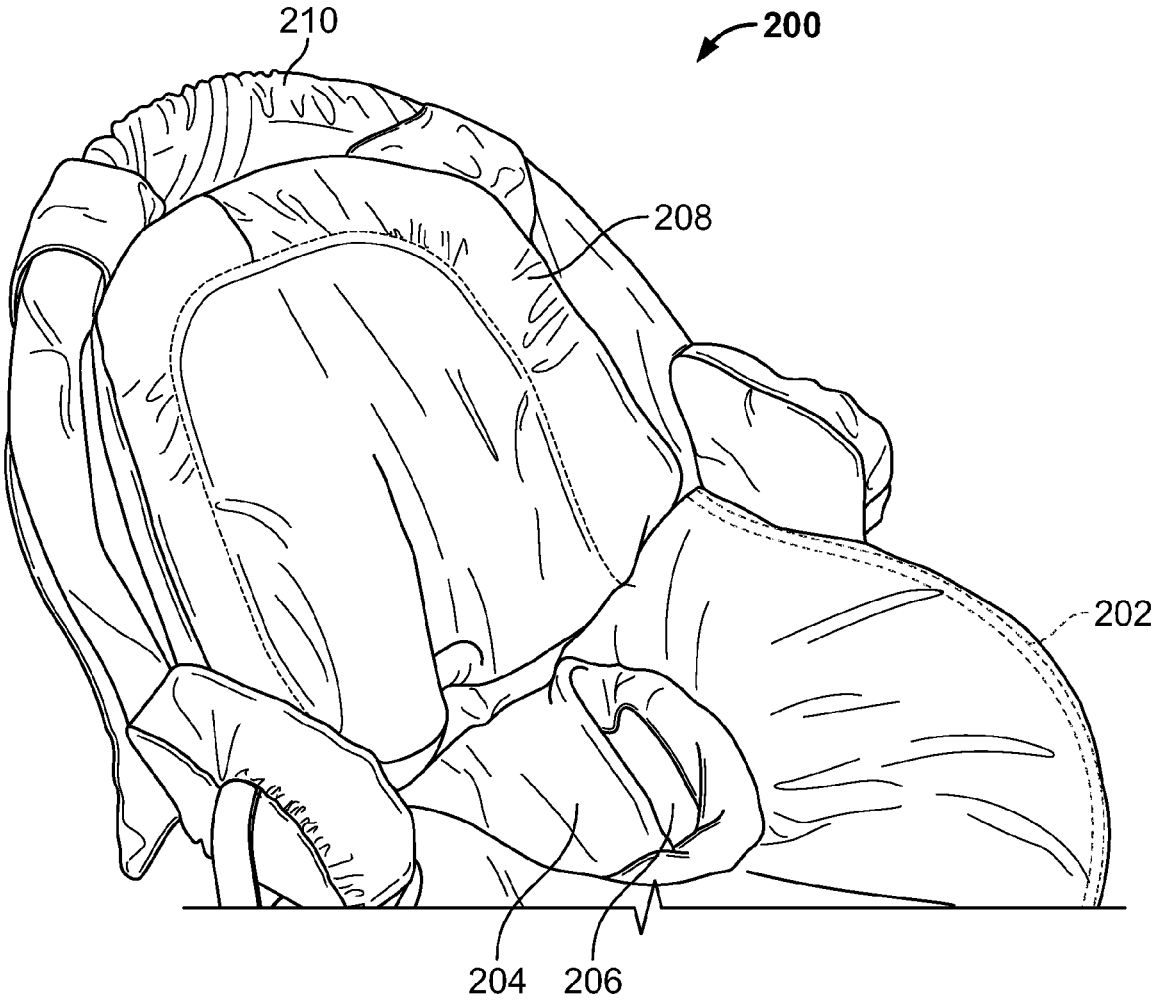

FIGS. 13A and 13B illustrate an example of a convertible swing/jumper seat 200 that may be used in conjunction with the apparatus 10. In this example, the seat 200 includes a frame such as, for example, at least one peripheral metal tube 202 having soft fabric 204 suspended between the peripheral tubes 202. In a swing operating mode (see FIG. 13A), a child may be placed in the seat 200 in a feet forward position. To configure the seat as a jumper (see FIG. 13B), the seat 200 and/or the soft fabric 204 defines leg openings 206 in its base to receive the legs of a child standing within the seat 200. A sculpted and/or contoured insert, such as for example, a plastic insert, may be inserted inside the fabric 204 of the seat 200 to assist in supporting the child and maintaining a more upright position while in the jumper mode. In this example, the leg openings 206 are covered or substantially covered by a soft fabric layer 208. The forward edge and/or other portion of the soft fabric layer 208 may be releasably attached to the seat pad and/or the seat back via elastic, hook and loop fastener, and/or any other suitable connector to secure the layer 208 in the position of FIG. 13A and/or in the raised position of FIG. 13B.

In the illustrated example, an adjustable canopy 210 is coupled to the seat 200 to provide shade to an infant located in the seat 200 in either the jumper or the swing mode. Additionally, a mechanical vibrator (not shown), or other desired device may be coupled to the apparatus 10 and/or the seat frame 202 to provide movement and/or vibrations that can soothe, or entertain an infant located in the seat 200 in either the jumper or the swing mode.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

We claim:

1. A child entertainment apparatus comprising:

a frame;

a support suspended for swinging movement relative to the frame, the support being elastically elongatable;

a seat carried by the support; and a drive arm extending between the frame and the seat and having a first end journalled for rotation relative to one of the frame or the seat and a second end slidably coupled to the other of the frame or the seat, wherein the seat is free to slide along the drive arm in both a swing mode and a bouncing mode of the apparatus.

2. An apparatus as defined in claim 1, wherein the support includes a first and a second telescoping tube coupled by a flexible connector.

3. An apparatus as defined in claim 2, wherein the first telescoping tube comprises a substantially rigid outer tube and the second telescoping tube comprises a substantially rigid inner tube, and wherein the substantially rigid inner tube is adapted to slide within the substantially rigid outer tube.

4. An apparatus as defined in claim 2, wherein the flexible connector is a spring.

5. An apparatus as defined in claim 4, wherein the spring is at least partially covered by the telescoping tubes.

6. An apparatus as defined in claim 4, further comprising a safety tether secured in parallel to the spring.

7. An apparatus as defined in claim 2, wherein the support includes a stop to prevent over elongation of the flexible connector.

8. An apparatus as defined in claim 1, further comprising a lock wherein in a first position, the lock prevents the support from being elastically elongated, and in a second position, the lock allows the support to be elastically elongated.

9. An apparatus as defined in claim 1, further comprising a height adjuster to adjust the height of the seat relative to a surface upon which the frame rests.

10. An apparatus as defined in claim 1, wherein the frame includes a base support and a vertical support extending substantially upward from the base support.

11. An apparatus as defined in claim 10, wherein the vertical support supports a cross bar, and wherein the support is suspended from the cross bar.

12. An apparatus as defined in claim 1, further comprising a drive mechanism coupled to the frame and adapted to reciprocally rotate the drive arm to cause the seat to swing.

13. An apparatus as defined in claim 1, wherein the seat includes a seat base and a seat back having a lower end coupled to the seat base and an upper end, and wherein the drive arm is operatively coupled to the seat at the upper end of the seat back.

14. An apparatus as defined in claim 13, wherein the drive arm is operatively coupled to an approximate midpoint of the upper end of the seat back.

15. An apparatus as defined in claim 1, further comprising a webbing extending between the seat and the support to close a potential entrapment area.

16. An apparatus as defined in claim 1, wherein the seat is movable between a feet forward position and a feet downward position.

17. An apparatus as defined in claim 16, wherein the seat defines leg openings.

18. An apparatus as defined in claim 1, wherein the drive arm is slidably coupled to the seat.

19. An apparatus as defined in claim 18, further comprising a connector coupled to the seat and adapted to slide along at least a portion of the drive arm.

20. An apparatus as defined in claim 1, wherein the seat further comprises a substantially rigid frame and a flexible material supported by the frame.

21. An apparatus as defined in claim 20, wherein the flexible material further comprises a cinch to adjust the shape of the seat.

22. A child entertainment apparatus comprising:

a frame;

a support suspended for swinging movement relative to the frame, the support being elastically elongatable;

a seat carried by the support and defining leg openings, wherein the seat is movable between a feet forward position and a feet downward position, and wherein the leg openings are substantially covered when in the feet forward position, and substantially uncovered when in the feet down position; and a drive arm extending between the frame and the seat and having a first end journalled for rotation relative to one of the frame or the seat and a second end slidably coupled to the other of the frame or the seat.

23. A child entertainment apparatus comprising:

a frame;

a support suspended for swinging movement relative to the frame, the support being elastically elongatable;

a seat carried by the support;

a drive arm extending between the frame and the seat and having a first end journalled for rotation relative to one of the frame or the seat and a second end slidably coupled to the other of the frame or the seat; and a connector coupled to the seat and adapted to slide along at least a portion of the drive arm, wherein the connector includes a mechanism to reduce friction between the drive arm and the connector.

24. An apparatus as defined in claim 23, wherein the mechanism to reduce friction comprises a roller.

25. A convertible swing and jumper apparatus comprising:

a frame having a cross bar;

a pair of supports suspended from the cross bar and journalled for swinging movement relative to the frame, each of the supports including at least two telescoping tubes joined by a spring;

a seat carried by the supports;

a connector coupled to the seat; and a drive arm extending between the frame and the seat and having a first end journalled for rotation relative to the frame and a second end slidably coupled to the connector such that the drive arm is to slide relative to the connector when the seat swings.

26. An apparatus as defined in claim 25, further comprising a drive mechanism coupled to the frame and adapted to reciprocally rotate the drive arm to cause the seat to swing.

27. An apparatus as defined in claim 25, wherein the connector is operatively coupled to the seat at an approximate midpoint of the upper end of the seat back.

28. A convertible swing and jumper apparatus comprising:

a frame having a cross bar;

a pair of supports suspended from the cross bar and journalled for swinging movement relative to the frame, each of the supports including at least two telescoping tubes joined by a spring;

a seat carried by the supports;

a connector coupled to the seat; and a drive arm extending between the frame and the seat and having a first end journalled for rotation relative to the frame and a second end slidably coupled to the connector, wherein the connector comprises a roller to slidably couple the drive arm to the connector.

29. A child entertainment apparatus comprising:

a frame;

a seat;

means for suspending the seat from the frame, the suspending means having a first mode wherein the seat is suspended for operation as a swing and a second mode wherein the seat is suspended for operation as a jumper, wherein the means for suspending the seat from the frame operates in the first mode, the second mode, or any combination thereof; and means for driving the seat, the driving means extending between the frame and the seat and having a first end journalled for rotation relative to one of the frame or the seat and a second end slidably coupled to the other of the frame or the seat such that the second end of the means for driving the seat slides relative to the other of the frame or the seat in at least the first mode.

30. An apparatus as defined in claim 29, further comprising a means to impart motion to the driving means.

31. An apparatus as defined in claim 29, further comprising locking means to selectively prevent the means for suspending the seat from the frame from operating in the second mode.

* * * * *